US009927762B2

(12) United States Patent
Dixon et al.

(10) Patent No.: US 9,927,762 B2
(45) Date of Patent: Mar. 27, 2018

(54) BIASED LUBRICANT APPLICATOR BRUSH IN IMAGING DEVICE

(71) Applicant: LEXMARK INTERNATIONAL, INC., Lexington, KY (US)

(72) Inventors: Michael J Dixon, Richmond, KY (US); Pramod K Sharma, Lexington, KY (US); Alan S Campbell, Lexington, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 15/168,652

(22) Filed: May 31, 2016

(65) Prior Publication Data

US 2017/0343954 A1 Nov. 30, 2017

(51) Int. Cl.
*G03G 21/00* (2006.01)

(52) U.S. Cl.
CPC ..... *G03G 21/0094* (2013.01); *G03G 21/0035* (2013.01)

(58) Field of Classification Search
CPC ..... G03G 21/0035; G03G 21/0094
See application file for complete search history.

(56) References Cited

U.S. PATENT DOCUMENTS 4,435,074 A 3/1984 Midorikawa
4,757,349 A 7/1988 Toshimitsu
5,204,034 A 4/1993 Sasame
5,272,029 A 12/1993 Sakai
5,321,582 A 6/1994 Casperson
5,463,456 A 10/1995 Yashiki
5,589,924 A 12/1996 Yano
5,646,718 A 7/1997 Suwa
5,771,424 A 6/1998 Lindblad
6,060,205 A 5/2000 Takeichi
6,160,977 A 12/2000 Takeichi
6,295,437 B1 9/2001 Hodoshima
6,295,438 B1 9/2001 Fujishiro
6,330,420 B1 12/2001 Honda
6,611,671 B2 8/2003 Shoji
6,768,879 B2 7/2004 Kosuge
6,775,511 B2 8/2004 Kosuge
6,778,805 B2 8/2004 Kai
6,922,543 B2 7/2005 Kanagawa
6,983,120 B2 1/2006 Ishii
7,035,582 B2 4/2006 Suda
7,149,465 B2 12/2006 Amemiya
(Continued)

*Primary Examiner* — Carla Therrien

(57) ABSTRACT

In an imaging device having a photoconductive drum and a lubricant applicator brush, methods and apparatus teach application of the lubricant to the drum at a transfer nip and removing undeveloped toner particles. A first voltage is applied to the drum while the brush receives a voltage that switches more positive and more negative than the first voltage. It attracts to the brush from the drum negatively and positively charged toner. Embodiments contemplate amounts of voltages and frequencies of switching. An elongate rod contacts the brush downstream of the transfer nip to flicker off the toner particles from the brush. The rod can also have voltages applied and switched greater than and lesser than the voltages of the applicator brush to facilitate toner removal. A cleaning blade downstream of the transfer nip scrapes clean a surface of the drum.

16 Claims, 3 Drawing Sheets

(56) References Cited

U.S. PATENT DOCUMENTS

| | | | | |
|---|---|---|---|---|
| 7,209,698 | B2 | 4/2007 | Tawada | |
| 7,209,699 | B2 | 4/2007 | Yamaguchi | |
| 7,302,197 | B2 | 11/2007 | Kosuge | |
| 7,313,347 | B2 | 12/2007 | Shintani | |
| 7,343,132 | B2 | 3/2008 | Kimura | |
| 7,373,101 | B2 | 5/2008 | Hozumi | |
| 7,376,380 | B2 | 5/2008 | Koike | |
| 7,392,008 | B2 | 6/2008 | Takahashi | |
| 7,430,377 | B2 | 9/2008 | Koike | |
| 7,459,257 | B2 | 12/2008 | Shirodai | |
| 7,480,473 | B2 | 1/2009 | Matsuura | |
| 7,486,914 | B2 | 2/2009 | Kabata | |
| 7,496,324 | B2 | 2/2009 | Sugiura | |
| 7,496,343 | B2 | 2/2009 | Khorram | |
| 7,505,728 | B2 | 3/2009 | Yamaguchi | |
| 7,536,147 | B2 | 5/2009 | Kageyama | |
| 7,542,712 | B2 | 6/2009 | Tanaka | |
| 7,542,713 | B2 | 6/2009 | Yoshida | |
| 7,583,925 | B2 | 9/2009 | Karasawa | |
| 7,593,682 | B2 | 9/2009 | Tokumasau | |
| 7,603,071 | B2 | 10/2009 | Sugiura | |
| 7,616,922 | B2 | 11/2009 | Yoshino | |
| 7,680,446 | B2 | 3/2010 | Shintani | |
| 7,691,791 | B2 | 4/2010 | Usami | |
| 7,693,475 | B2 | 4/2010 | Shakuto | |
| 7,702,257 | B2 | 4/2010 | Kosuge | |
| 7,706,735 | B2 | 4/2010 | Kishi | |
| 7,715,750 | B2 | 5/2010 | Kagawa | |
| 7,725,069 | B2 | 5/2010 | Kawahara | |
| 7,756,447 | B2 | 7/2010 | Kosuge | |
| 7,826,786 | B2 | 11/2010 | Suda | |
| 7,831,189 | B2 | 11/2010 | Harada | |
| 8,913,943 | B2 * | 12/2014 | Nakane | G03G 21/0035 399/346 |
| 2010/0080587 | A1 * | 4/2010 | Booth | G03G 15/0266 399/44 |
| 2010/0226666 | A1 * | 9/2010 | Nakatsuhara | G03G 21/0035 399/43 |
| 2011/0143024 | A1 * | 6/2011 | Nakane | G03G 21/0094 427/154 |
| 2014/0334836 | A1 * | 11/2014 | Yoshiyama | G03G 15/065 399/53 |
| 2015/0030364 | A1 * | 1/2015 | Ito | G03G 21/0094 399/346 |

* cited by examiner

BIASED LUBRICANT APPLICATOR BRUSH IN IMAGING DEVICE

FIELD OF THE INVENTION

The present disclosure relates to a lubricant applicator brush in an imaging device. It relates further to electrically biasing the brush to improve application of lubrication to a photoconductive drum and to remove toner particles.

BACKGROUND

Photoconductive (PC) drums have long been used in electrophotographic (EP) processes for transferring imaging data to media. They are installed as replaceable components of imaging devices, e.g., laser printers, copiers, fax machines, multifunction devices, etc. They come packaged as stand-alone units or as part of toner cartridges. Manufacturers continually seek to decrease their wear rates and improve longevity. Certain designs facilitate the addition of lubricants, such as zinc stearate. An applicator brush scrapes the lubricant and applies it to a drum surface at a transfer nip during rotation of both the brush and the drum. As the drum is electrically charged as part of the EP process, the brush is typically connected to electrical ground to prevent applying any undesirable charges. An elongate rod contacts the brush to flicker away any residual toner stuck to the brush after the transfer nip. A cleaning blade also scrapes clean the surface of the drum either downstream or upstream of the transfer nip. Improvements are continually sought.

SUMMARY

The above and other configurations are improved by biasing a lubricator applicator brush in an imaging device. A first voltage is applied to the PC drum while the brush receives a voltage that switches more positive and more negative than the first voltage. It attracts to the brush from the drum negatively and positively charged toner. It eliminates packing the brush with toner of only one polarity. Various embodiments contemplate amounts of voltages and frequencies of switching. An elongate rod contacts the brush downstream of the transfer nip to flicker off the toner particles from bristles of the brush. The rod can also have voltages applied and switched more positive and more negative than the voltages of the applicator brush to facilitate toner removal. A cleaning blade downstream of the transfer nip scrapes clean a surface of the drum. Effective cleaning of the applicator brush enables consistent addition of lubricant to the surface of the drum. It is believed that even further adjustments to the brush bias can be used to increase or decrease the amount of zinc stearate lubricant added to the PC surface. These and other embodiments are described below.

DETAILED DESCRIPTION OF THE ILLUSTRATED EMBODIMENTS

Figure 1:
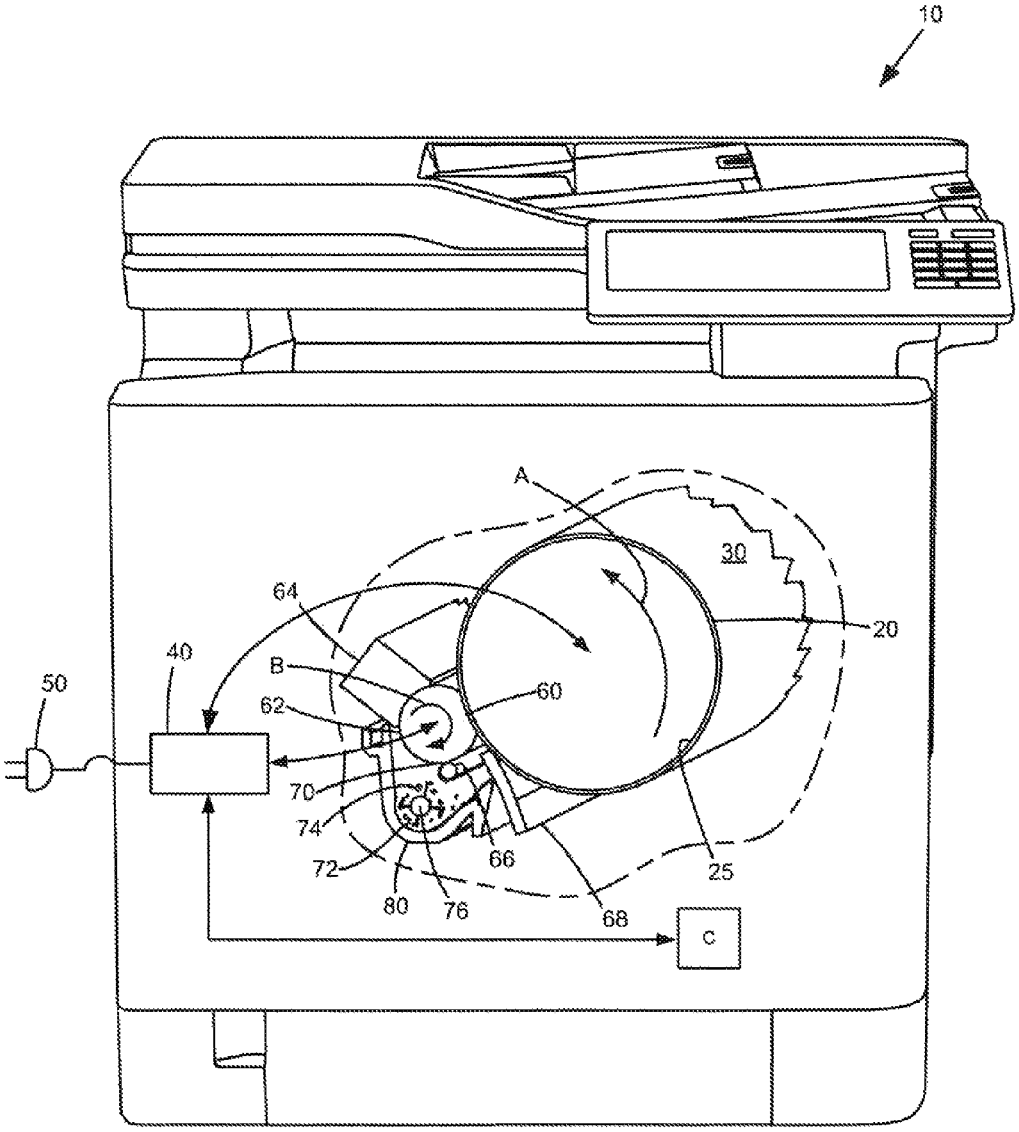
FIG. 1 is a diagrammatic view of an imaging device, including cutaway with exaggerated partial diagrammatic view of a photoconductive drum, lubricant, applicator brush and elongate rod.

With reference to FIG. 1, an imaging device 10 includes a photoconductive (PC) drum 20. The drum has a core 25 upon which one or more layers are fashioned to create a photosensitive drum surface 30. A laser or other light source (not shown) discharges the drum surface in the form of a latent image so toner particles become attracted to it. The toner gets transferred to a media sheet or an intermediate transfer member, as is familiar. The core is biased with one voltage potential, while the surface is biased to another and traditional means are used to apply the voltages, such as through rollers, coronas, or the like. The voltages come from connection to a high voltage power supply 40 that derives its potentials from connection to an external power source at 50. A controller C, such as an ASIC(s), circuit(s), microprocessor(s), etc., regulates their application.

At a transfer nip 60, lubricant is applied to the surface of the drum to extend the life of the drum and minimize its wear rate. The lubricant is any of a variety, but zinc stearate has been found to work well. An applicator brush 62 extends along an axial length of the drum and contacts the drum at the transfer nip 60 for a distance of about 3-6 mm, depending on design. The brush and drum rotate in the direction of their action arrows A, B. The brush rotates into contact with the lubricant 62, which extends along an axial length of the brush. As the brush rotates, bristles of the brush scrub off flakes of the lubricant which remain situated on the bristles. At the transfer nip 60, the flakes transfer off the bristles and onto the surface of the drum. The applicator brush is also rotated at a speed faster than a speed of the drum surface 30 to improve transfer action. It has been found that rotation of the brush at a speed of about eight percent (8%) faster than the drum works well.

As the applicator brush continues rotating downstream of the transfer nip 60, it contacts an elongate rod 66 at nip 70. The action of the bristles coming into contact with the rod causes flakes of lubricant remaining on the brush to flicker off. That undeveloped toner particles also attach to the brush at the transfer nip 60, the rod flickers off toner too. The rod extends along the axial length of the brush. The rod is typically a metal bar, such as stainless steel. A cleaning blade 68 downstream of the transfer nip 60 scrapes off other undeveloped toner that remains on the surface of the PC drum. Both the lubricant flakes 72 and toner 74 flickered off the brush by the rod and/or cleaning blade can collect in a sump of a bin 80 for disposal. An auger 76 can rotate to move out the collected particles.

Figure 2:
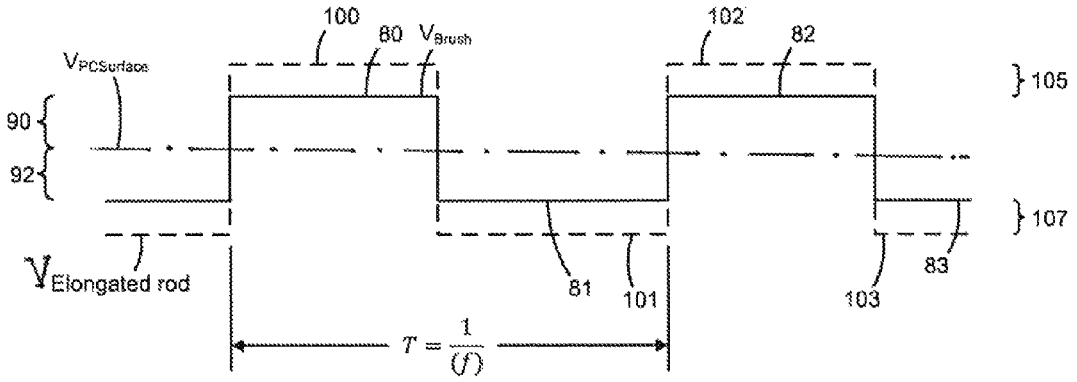
FIG. 2 is a diagrammatic view of a voltage biasing scheme.

With reference to FIG. 2, electrical biases are applied to the applicator brush to improve application of the lubricant to the drum at the transfer nip and to remove toner particles. Instead of merely grounding the brush, the inventors have discovered that alternating a voltage bias more positive and more negative than the voltage of the surface of the drum improves both application of the lubricant and removal of toner. In one embodiment, the surface of the drum is held at a substantially constant voltage of about −600 volts. The voltage applied to the brush, on the other hand, switches more positive 80, 82 and more negative 81, 83 than the drum voltage. As the brush is switched more positively biased than the drum it attracts to it negatively signed toner. Conversely, it attracts to it more positively signed toner as the brush is switched more negatively biased than the drum.

In other embodiments, the amount of voltage applied to the brush is switched higher and lower than the voltage applied to the drum in substantially equally amounts. That is, the magnitude of voltage 90, 92 is substantially the same in comparison to the voltage of the drum surface. The frequency (f) of switching from one voltage applied to the brush to a next voltage applied to the brush occurs such that as a segment of the photoconductive drum rotates into contact with the applicator brush at the transfer nip, the voltage switches from more positively biased 80 than the drum to more negatively biased 81 at least once as the segment of the drum remains in contact at the transfer nip.

Also, a voltage bias can be applied to the elongate rod to facilitate removal of oppositely signed toner at the nip where the brush and rod contact one another. In one design, the voltage applied to the rod switches even more positive 100, 102 and more negative 101, 103 than the voltage applied to the brush. The magnitude of voltage 105, 107 is substantially the same greater or lower than the voltage of the brush, as it is also of the same magnitude relative to the voltage of drum surface. The frequency (f) of switching from one voltage applied to the rod to a next voltage applied to the rod can occur at the same time the voltage of the brush switches relative to the drum or at other times.

As a rough estimate, the speed of rotation of the brush is approximately 600 rpm (in one embodiment) and the distance of brush travel at the transfer nip is about 6 mm and 2.5 mm at the nip with the elongate rod. Thus, for a 12.8 mm diameter brush, its surface speed is approximately ~400 mm/second and it traverses the first nip with the drum in about 0.015 seconds and the second nip with the elongate rod in about 0.006 seconds. In turn, the frequencies of switching (f) from a more positively biased voltage to a more negatively biased voltage occurs at a minimum of 67 Hz (f=1/0.015) and 167 Hz (f=1/0.006), respectively. To set the upper bound on the frequency of switching voltages, the inventors believe it relates to the timescale for disengagement and movement of toner particles, EPAs (extra particulate additive) and zinc stearate particles from the brush. Based on electrophotographic frequencies at the toner development nip (not shown) on the order of thousands of Hz, (especially one design at 6400 Hz at 60 pages per minute) and tests up to 10 kHz with no degradation found in the behavior of toner development, the inventors believe that the optimal frequency for the frequency of switching would fall in the range of 200 Hz and 20 KHz.

Figure 3:
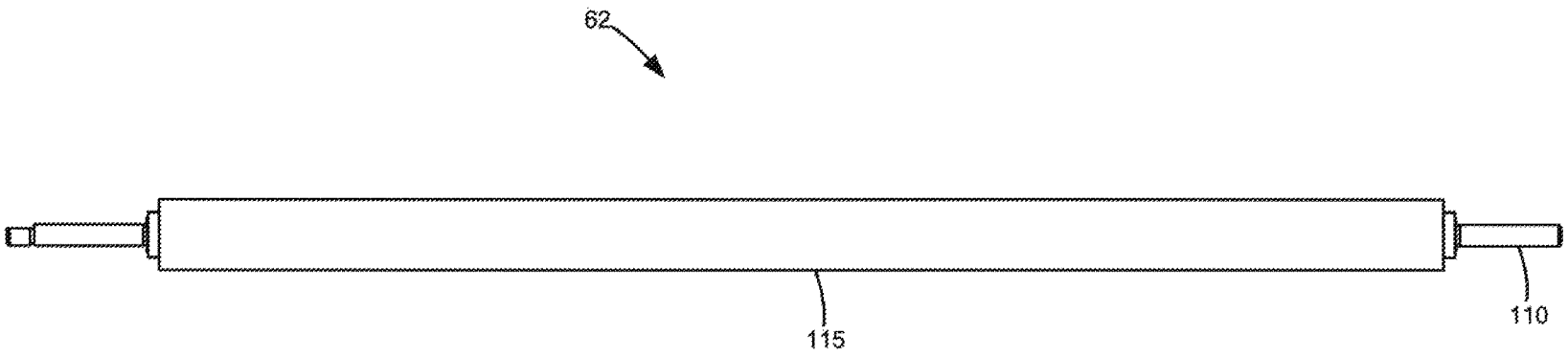
FIG. 3 is a diagrammatic view of an applicator brush.

With reference to FIG. 3, the brush itself can be formed in a variety of ways. In one embodiment, a shaft 110 of the brush is steel, including a nickel plating. The bristles 115 of the brush are applied to the shaft and are of polyester/acrylonitrile composition. The outer diameter of the shaft is about 6 mm, while in the vicinity of the bristles it is about 12 mm. The bristles are about 45% carbon black loaded by weight to achieve a desired resistivity. Other fibers can range from about 5% to 45% carbon black. Further properties of the fibers are as follows:

| Property | Specification Value/Range | Units |
|---|---|---|
| Linear Density/# Filaments (spun thread) | 330/48 | T/F |
| Brush Density | 50 | $kF/in^2$ |
| Linear Density | 6.9 | T |
| Fiber Diameter (nominal) | 27 | μm |
| Specific Gravity | 1.2-1.25 | (unit less) |
| Tensile Strength | 1.3-2.2 | cN/T |
| Young's Modulus | 1500-3350 | $N/mm^2$ |
| Water Adsorption | 3.5-4.5 | % (@ 20° C. and 65% RH) |

The foregoing illustrates various aspects of the invention. It is not intended to be exhaustive. Rather, it is chosen to provide the best mode of the principles of operation and practical application known to the inventors so one skilled in the art can practice it without undue experimentation. All modifications and variations are contemplated within the scope of the invention as determined by the appended claims. Relatively apparent modifications include combining one or more features of one embodiment with those of another embodiment.

The invention claimed is:

1. In an imaging device having a photoconductive drum and a lubricant applicator brush in contact with the photoconductive drum at a transfer nip, the applicator brush also being contacted by an elongate rod, a method of cleaning the photoconductive drum, comprising:

applying a first voltage to the photoconductive drum;

applying a second and third voltage to the applicator brush such that as a segment of the photoconductive drum rotates into contact with the applicator brush at the transfer nip, the second voltage applied to the applicator brush is more positive than the first voltage applied to the photoconductive drum and the third voltage applied to the applicator brush is more negative than the first voltage applied to the photoconductive drum;

applying a fourth voltage to the elongate rod; and switching the fourth voltage on the elongate rod to a fifth voltage, the fourth voltage being more positive than the second voltage and the fifth voltage being more negative than the third voltage applied to the applicator brush.

2. The method of claim 1, further including rotating the applicator brush into contact with the elongate rod at a nip downstream of the transfer nip in a direction of rotation of the applicator brush.

3. The method of claim 1, further including positioning into contact with the applicator brush a lubricant bar of zinc stearate such that as the applicator brush rotates, the applicator brush applies the zinc stearate to a surface of the photoconductive drum at the transfer nip.

4. The method of claim 1, further including applying the first voltage to the photoconductive drum at about −600 volts.

5. The method of claim 1, further including applying the second voltage and the third voltage to the applicator brush at voltages having substantially a same magnitude greater than and lesser than the first voltage applied to the photoconductive drum.

6. The method of claim 1, further including arranging a cleaning blade to contact a surface of the photoconductive drum at a position downstream of the transfer nip as the photoconductive drum rotates.

7. The method of claim 1, further including rotating both the photoconductive drum and the applicator brush, wherein the rotation of the applicator brush is faster than the rotation of the photoconductive drum.

8. The method of claim 7, further including rotating the applicator brush into contact with the lubricant upstream of the photoconductive drum in a direction of travel of the applicator brush such that the lubricant transfers to a surface of the photoconductive drum at the transfer nip.

9. In an imaging device having a photoconductive drum and an applicator brush for applying lubricant to the photoconductive drum at a transfer nip, the imaging device further including an elongate rod into which the applicator brush is contacted at a nip downstream from the transfer nip in a direction of travel of the applicator brush to remove toner particles from the applicator brush, a method of cleaning the photoconductive drum, comprising:

applying a substantially constant-value first voltage to the photoconductive drum;

switching a second and third voltage to the applicator brush greater than and less than the constant value first voltage to attract to the applicator brush negatively and positively charged toner particles;

applying a fourth voltage to the elongate rod; and switching the fourth voltage on the elongate rod to a fifth voltage, the fourth and fifth voltages respectively being more positive and more negative than the second and third voltages respectively applied to the applicator brush.

10. The method of claim 9, wherein the switching the second and third voltage further includes switching substantially equal voltage amounts higher and lower than the constant value first voltage.

11. In an imaging device having a photoconductive drum and an applicator brush for applying lubricant to the photoconductive drum at a transfer nip, a method of cleaning the photoconductive drum, comprising:

applying a first voltage to the photoconductive drum;

applying a second voltage to the applicator brush more positive than the first voltage;

switching the second voltage on the applicator brush to a third voltage on the applicator brush more negative than the first voltage; and rotating the applicator brush into contact with an elongate rod at a nip downstream of the transfer nip in a direction of travel of the applicator brush to remove toner particles from the applicator brush, including applying a fourth voltage to the elongate rod and switching the fourth voltage on the elongate rod to a fifth voltage, the fourth voltage being more positive than the second voltage and the fifth voltage being more negative than the third voltage applied to the applicator brush.

12. The method of claim 11, further including rotating the applicator brush into contact with the lubricant for applying the lubricant to a surface of the photoconductive drum at the transfer nip.

13. The method of claim 11, further including switching the third voltage on the applicator brush back to the second voltage and repeating.

14. The method of claim 13, wherein the switching the second voltage on the applicator brush to a third voltage further includes switching substantially equal amounts of voltage higher and lower than the first voltage applied to the photoconductive drum.

15. The method of claim 11, wherein the applying the first voltage to the photoconductive drum includes applying a core voltage and a surface voltage, the surface voltage being about −600 volts on a surface of the photoconductive drum.

16. In an imaging device having a photoconductive drum, a lubricant and an applicator brush, a method for applying lubricant to the photoconductive drum at a transfer nip, comprising:

applying a first voltage to the photoconductive drum;

applying to the applicator brush a second voltage more positive than the first voltage;

rotating the applicator brush into contact with the lubricant to gather the lubricant thereon;

rotating the applicator brush further to contact a surface of the photoconductive drum; and switching the second voltage applied to the applicator brush to a third voltage more negative than the first voltage when the applicator brush contacts the photoconductive drum at the transfer nip to transfer to the surface of the photoconductive drum the lubricant from the applicator brush and to attract to the applicator brush toner particles from the surface of the photoconductive drum;

rotating the applicator brush into contact with an elongate rod at a nip downstream of the transfer nip in a direction of travel of the applicator brush to remove toner particles from the applicator brush;

applying a fourth voltage to the elongate rod; and switching the fourth voltage on the elongate rod to a fifth voltage, the fourth voltage being more positive than the second voltage and the fifth voltage being more negative than the third voltage applied to the applicator brush.

* * * * *